United States Patent [19]

Loiacono

[11] 4,090,320

[45] May 23, 1978

[54] SMOKE RING BOX

[76] Inventor: Carmelo Loiacono, 442 Third Ave., New York, N.Y. 10016

[21] Appl. No.: 706,158

[22] Filed: Jul. 19, 1976

[51] Int. Cl.[2] ..... A63H 33/28; A24F 13/30

[52] U.S. Cl. ..... 46/9; 92/90; 222/209; 239/325; 239/357; 252/359 R; 46/44

[58] Field of Search ..... 252/359 R, 359 A, 359 CG, 252/305; 239/325, 357, 290; 116/114 F, 114 N; 46/9, 217, 44; 222/209, 389; 417/383; 92/90

[56] References Cited

U.S. PATENT DOCUMENTS

| | | | |
|---|---|---|---|
| 1,771,358 | 7/1930 | Shields | 46/9 |
| 1,891,466 | 12/1932 | Banks | 46/9 |
| 2,352,677 | 7/1944 | Anderson et al. | 252/359 A |
| 2,546,123 | 3/1951 | Goldfarb | 46/9 |
| 2,788,607 | 4/1957 | Ward | 46/9 |
| 3,651,994 | 3/1972 | Nordenholt | 222/389 X |

FOREIGN PATENT DOCUMENTS

| | | | |
|---|---|---|---|
| 961,630 | 6/1964 | United Kingdom | 46/9 |

*Primary Examiner*—Norman Yudkoff
*Assistant Examiner*—Barry I. Hollander
*Attorney, Agent, or Firm*—Leonard W. Suroff

[57] ABSTRACT

A smoke ring device that permits the user to create through an outlet on the housing thereof a series of smoke rings created from a fine powder by generating means contained within the housing having associated therewith pumping means for manually obtaining an air current flow relative to the fine powder to form puffs of powder in an air passage contained within the housing. Deflecting means is mounted within the housing adjacent the outlet and communicating with the air passage for creating air turbulence in a direction to lift the powder from the container and form a smoke ring when exiting from the outlet.

3 Claims, 2 Drawing Figures

FIG.1
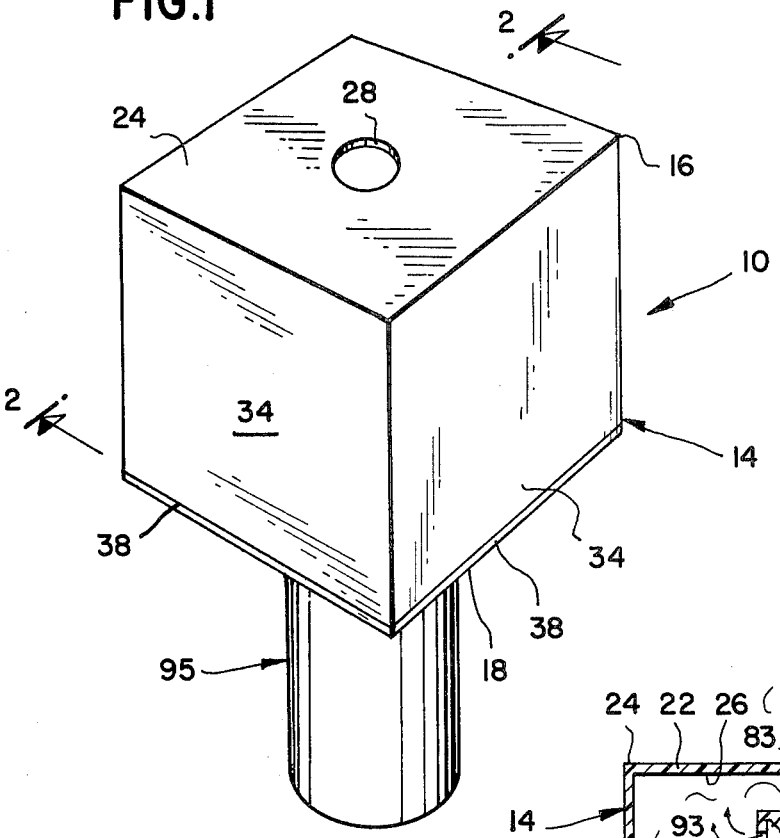
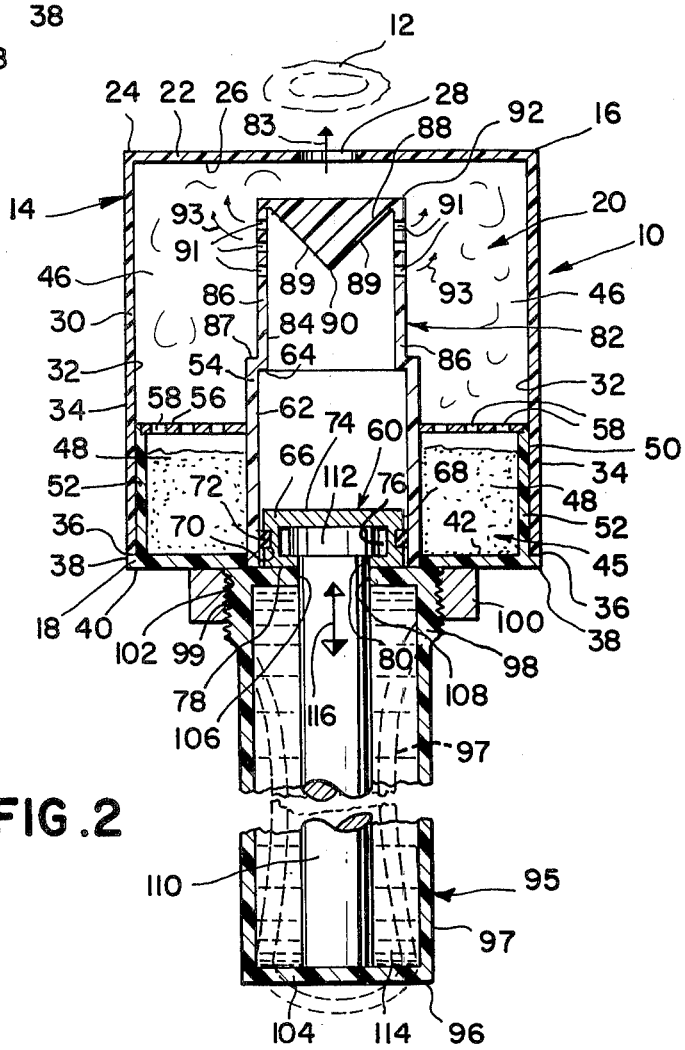
FIG.2

SMOKE RING BOX

BACKGROUND OF THE INVENTION

The present invention relates to a device for emitting simulated puffs of smoke in the form of smoke rings.

The device provides the user with a toy in which a powdered mist is formed into a smoke ring or the like for purposes of signaling or other uses. The device contains a harmless fine powder such as flour or talcum powder and which may be formed to obtain a realistic visual effect of a puff of smoke emanating from the device.

OBJECTS OF THE INVENTION

An object of the present invention is the provision of a novel form of device for producing smoke rings which can be economically manufactured and easily refilled.

Another object of the present invention is to provide a very simple and inexpensive toy device which is safe in operation and of great play value to children.

Another object of the present invention is to provide a device for creating smoke rings which will require absolutely no skill on the part of the user.

Other objects and advantages of the present invention will become apparent as the disclosure proceeds.

SUMMARY OF THE INVENTION

A smoke ring device is disclosed that includes a housing having an outlet at the upper end thereof, with smoke generating means having fine powder therein communicating with the housing in spaced relation to the outlet with an air passage therebetween. Pumping means is provided in the housing for manually obtaining an air current flow relative to the fine powder to form puffs of powder in the air passage with deflecting means mounted within the housing adjacent the outlet and communicating with the air passage for creating air turbulence in a direction to force a puff of powder outwardly through the outlet such that a puff of powder is formed into a ring when exiting from the outlet.

The pumping means includes a vertically extending cavity; and a piston mounted in the cavity for reciprocation in the cavity to obtain the air current flow. The deflecting means includes a duct in communicating relation with the cavity, having a deflector positioned at one end of the duct, and a plurality of radially extending apertures adjacent the deflector, such that as the piston creates the air current flow the air is forced outwardly through the apertures.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a perspective of the smoke ring device in accordance with the present invention; and FIG. 2 is a sectional view taken along the line 2—2 of FIG. 1.

DETAILED DESCRIPTION OF THE DRAWINGS

Referring to the drawings there is illustrated a smoke ring device 10 that is adapted to be hand held and create smoke rings 12 on a repetitive basis. The smoke ring device 10 includes a housing 14 that may be made in two sections consisting of a cover 16 and base 18 with the cover 16 adapted to be removed from its assembled relation with the base 18 in order to gain access to the cavity means 20 contained therein.

The cover 16 includes an upper wall or top 22 having an upper surface 24 and spaced apart inner surface 26 that forms part of the cavity means 20. An outlet aperture or opening 28 extends through the top 22 of the cover 16. The top 22 may be substantially flat and having associated therewith downwardly extending side walls 30 having inner surfaces 32 that form part of the cavity means 20 and outer surfaces 34. The side walls 30 may be integrally formed with the top wall 22 and may be formed into a rectangular configuration as seen in FIG. 1 or some other desired shape with the side walls 30 terminating at the lower end 36 which may extend in a horizontal plane. The base 18 may extend in a substantially horizontal plane and include a peripheral lip or rim 38 adapted to receive thereon the lower end 36 of the cover 16. In this manner, the cover may be easily removed from its assembled relationship with the base 18. The base has a bottom or lower surface 40 and upper surface 42 in spaced relation to each other.

Smoke generating means 45 is contained within the housing 14 and in spaced relation to the outlet 28 with an air passage 46 between the smoke generating means 45 and outlet 28. The air passage 46 extends through and may form part of the cavity means 20 in order to permit a flow of air therethrough. The smoke generating means 45 includes a fine powder 48 that may be talcum powder, flour or some other chemical that will produce a realistic visual effect of a puff of smoke emanating from the outlet 28 to form the smoke rings 12. A container 50 is provided and is formed by an upwardly extending side wall 52 that may be integrally formed with or positioned on the base 18 and having a tubular member or wall 54 which forms the inner end of the container 50. To limit the amount of powder 48 that exits from the container 50, a screen 56 extends over the open end of the container 50 and by selecting the size of the screen openings 58 the amount of powder released therefrom is controlled and limited.

The container 50 may be of a replaceable type such that the powder 48 may come prepackaged such that the user of the device 10 could separate the cover 16 from the base 18 and replace it with a new container 50. As illustrated, the screen 56 is removable from the position shown in FIG. 2 and upon removing thereof the powder 48 may be poured into the container until the appropriate level is obtained. The screen 56 is then replaced and when the cover 16 is repositioned on the base 18 the device is once again operational.

In order to obtain the flow of air in the air passage 46 and across the surface of the screen 56 to cause the powder 48 to be removed therefrom, pumping means 60 is provided in the housing 14 for manually obtaining the required air flow to obtain the turbulence to form puffs of powder in the air passage 46 such that the ring 12 is formed upon exiting from the outlet 28. The pumping means 60 includes a vertically extending cavity 62 which may coincide with the inner wall of the tubular member 54. The cavity 62 extends vertically and may be in coaxial alignment with the outlet 28. The cavity 62 may have an inwardly extending tab or ledge 64 which acts as means for limiting the vertical travel of a piston 66 mounted in the cavity 62 for reciprocation in the cavity 62 to obtain the air current flow. The piston 66 includes an outer surface 68 having a radially extending annular groove 70 for receiving therein an o-ring 72 to provide sealing engagement between the piston 66 and the cavity 62. The piston 66 includes an upward end or surface 74 which is limited in it vertical travel by the ledge 64.

In order to obtain the reciprocation of the piston 66 a recess 76 is provided within the piston 66 and spaced between the bottom end 78 and the top end 74 of the piston 66. An opening 80 extends between the recess 76 and the bottom end 78. The dimensional relationships of the opening 80 and recess 76 is such that the finger of the user may fit therein and be used for reciprocation of the piston 66. Other means for reciprocation of the piston 66 may be utilized as hereinafter described.

In order to obtain the proper air turbulence deflecting means 82 is provided and mounted within the cavity means 20 adjacent the outlet 28 and communicating with the air passage 46 for creating air turbulence in a direction to force a puff of powder 48 outwardly through the outlet 28 such that the puff of powder 48 is formed into the smoke ring 12 when exiting from the outlet 28 in the direction of vertically extending arrow 83. The deflecting means 82 includes a duct 84 in communicating relation with the cavity 62 and in coaxial alignment therewith. The duct 84 includes a duct wall 86 connected at one end to the upper end 87 of the tubular member 54. A deflector 88 is positioned at one end of the duct 84 and having a conical surface 89 that extends upwardly and outwardly from its lower end 90. The conical or angularly disposed surface 89 may approximate forty-five degrees in order to properly deflet the air contained within the cavity 62 and duct 84 when the piston 66 moves upwardly. A plurality of radially extending apertures 91 extend through the duct wall 86 to permit the entrapped air to exit therefrom to create the air turbulence indicated by arrows 93 contained within the cavity means 20. The upper end 92 of the deflector means 82 is in horizontal spaced relationship to the wall 22 and in facing relation to the outlet 28. The vertical space is selected, as well as the diameter of the cavity wall 86 is selected, to permit the proper air flow.

In operation the compressed air exits through the apertures 91 which as seen in FIG. 2 are positioned approximate the deflecting inclined surface 89 in order to direct the flow of air outwardly therefrom. Upon the return stroke, or lowering of the piston 66, air rushes into the cavity 62 and duct 84 to refill it with a fresh supply of air which will in turn be used to create another smoke ring 12.

The cover 16 and base 18 may be made from plastic, metal, or even wood, if so desired, and the related container 50, tubular member 54, and duct wall 86, made from a selected material. The piston 66 may also be made from a variety of materials.

To facilitate the reciprocation of the pumping means 60, handle means 95 has been provided and extends downwardly from the lower end 40 of the base 18 and adapted to be grasped by the user. The handle means 95 includes an elongated hollow handle 96 having a flexible side wall 97 that is vertically extending and made of a compressible material such as thin plastic such that gripping by the user can cause deflection thereof. The handle 96 has an annular flange 98 at the upper end thereof with threads 99 contained thereon. A mounting plate 100 is connected to the bottom surface 40 of the base 18 and includes mating threads 102 adapted to receive the threads 99 therein. The mounting plate 100 may be integrally formed with the base 18. The handle 96 further includes a bottom 104 and an upper member or top 106 having an axial opening 108. The axial opening 108 is in coaxial alignment with the axis of the piston 66. A plunger 110 vertically extends within the handle 96 and secured as by an enlarged head 112 within the recess 76 contained within the piston 66. A fluid 114 is contained within the hollow handle 96 such that compression of the side wall 97 of the handle 96 causes displacement of the fluid 114 which acts on the plunger 110 from within the handle 96. This displacement causes the plunger 110 to move upwardly from within the handle 96 to reciprocate the pumping means 60 in the direction of the double headed arrow 116.

When the user of the device 10 relaxes his or her fingers from gripping relation with the side wall 97, the plunger 110 will move downwardly and reassume the position seen in FIG. 2. When the wall 97 is again deflected and since there is a sealed relationship at the interfaces then upon vertical movement of the plunger 110 the piston 66 will move upwardly and the air will be displaced which, as explained above, creates the air turbulence which in turn forms the smoke ring 12.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A smoke ring device, comprising:

A. a housing having an outlet at the upper end thereof,

B. smoke generating means having fine powder therein communicating with said housing in spaced relation to said outlet with an air passage therebetween, C. said smoke generating means including:

i. a container having said fine powder contained therein, and ii. a screen extending over the open end of said container to limit the amount of powder released therefrom, D. pumping means in said housing for manually obtaining an air current flow relative to said fine powder in said container to form puffs of powder in said air passage, E. said pumping means including:

i. a vertically extending cavity, and ii. a piston mounted in said cavity for reciprocation in said cavity to obtain the air current flow, F. deflecting means mounted within said housing adjacent said outlet and communicating with said air passage for creating air turbulence in a direction to force a puff of powder outwardly through said outlet such that a puff of powder is formed into a ring when exiting from said outlet, G. handle means operatively associated with said housing and comprising:

i. an elongated hollow handle extending from the bottom of said housing and in axial alignment with said vertically extending cavity, ii. a plunger axially extending within said handle and secured at one end thereof to said piston, and iii. a fluid contained within said hollow handle, such that compression of said handle forces said plunger to move upwardly from within said handle to advance said plunger, and H. said deflecting means including:

i. a duct in communicating relation with said cavity, ii. a deflector positioned at one end of said duct, and iii. a plurality of radially extending apertures adjacent said deflector, such that as said piston is reciprocated by compression of said handle and moves forward, air currents are created that flow outwardly through said apertures.

2. A smoke ring device as defined in claim 1, wherein said housing includes a base having a bottom wall with said container associated with said base for retaining said powder therein, and a cover mounted on said base with said outlet at the upper end of said cover and with said air passage extending between said powder and said outlet.

3. A smoke ring device as defined in claim 2:

a. wherein said cover is removably secured to said base, b. wherein said screen is removable from said container to permit access thereto for replacement of said powder, c. wherein said container extends peripherally around said cavity, and d. wherein said deflector has a conical surface to deflect air through said radially extending apertures.

* * * * *